US010525526B2

(12) United States Patent
Schäfer et al.

(10) Patent No.: US 10,525,526 B2
(45) Date of Patent: Jan. 7, 2020

(54) METHOD FOR PRODUCING A FEEDER WITH A MESH-LIKE FABRIC COVERING OVER THE FEEDER OPENING THEREOF

(71) Applicant: GTP Schäfer Giesstechnische Produkte GmbH, Grevenbroich (DE)

(72) Inventors: Jörg Schäfer, Frechen (DE); Thomas Schäfer, Frechen (DE)

(73) Assignee: GTP Schäfer Giesstechnische Produkte GmbH, Grevenbroich (DE)

( * ) Notice: Subject to any disclaimer, the term of this patent is extended or adjusted under 35 U.S.C. 154(b) by 0 days.

(21) Appl. No.: 16/085,992

(22) PCT Filed: Mar. 10, 2017

(86) PCT No.: PCT/EP2017/055663
§ 371 (c)(1),
(2) Date: Sep. 17, 2018

(87) PCT Pub. No.: WO2017/157788
PCT Pub. Date: Sep. 21, 2017

(65) Prior Publication Data

US 2019/0105706 A1 Apr. 11, 2019

(30) Foreign Application Priority Data

Mar. 18, 2016 (DE) ..... 10 2016 105 106

(51) Int. Cl.
*B22C 9/08* (2006.01)
*B22C 7/06* (2006.01)

(52) U.S. Cl.
CPC ..... *B22C 9/088* (2013.01); *B22C 7/06* (2013.01); *B22C 9/084* (2013.01)

(58) Field of Classification Search
CPC ..... B22C 9/08; B22C 9/084; B22C 9/088; B22C 7/06
See application file for complete search history.

(56) References Cited

U.S. PATENT DOCUMENTS

2015/0283602 A1* 10/2015 Schafer ..... B22D 17/2023 164/137

FOREIGN PATENT DOCUMENTS

| | | | | |
|---|---|---|---|---|
| DE | 2446554 A1 | | 4/1975 | |
| DE | 102014115848 A1 | | 4/2015 | |
| DE | 202015104553 U1 | | 10/2015 | |
| DE | 202015104554 U1 | | 10/2015 | |
| FR | 2588768 A1 | | 4/1987 | |
| GB | 1464117 A | * | 2/1977 | ..... B22C 9/084 |
| WO | 2017157788 A1 | | 9/2017 | |

OTHER PUBLICATIONS

Hodiamont, "International Search Report and Written Opinion of PCT/EP2017/055663", dated May 30, 2017, 11 pages.

* cited by examiner

*Primary Examiner* — Kevin P Kerns
*Assistant Examiner* — Steven S Ha
(74) *Attorney, Agent, or Firm* — Johnson, Marcou & Isaacs, LLC; Jennifer S. Stachniak

(57) ABSTRACT

A method for producing a feeder (10) that is intended for use in a casting mold used for the casting of metals and comprises a feeder body (11), which encloses an inner cavity (25) as a feeder volume, consists of an exothermic and/or insulating material, has at least one lateral wall region (12) and a bottom region (13) with a feeder opening (14) arranged therein for connecting the inner cavity (25) of the feeder body (11) to the mold cavity of the casting mold during the casting operation and has a mesh-like fabric consisting of a refractory material covering over the feeder opening (14) therein, is characterized in that, in the course of the production of the feeder in a core shooter, a piece of fabric (21) of the mesh-like fabric is positioned in a pattern device (17) forming the shape of the feeder (10) in a core box (30) of the core shooter, in such a way that the peripheral region (22) of the piece of fabric (21) positioned in the bottom region (13) of the later feeder (10) is at least partially bent up in the direction of the lateral wall region (13) of the feeder body (11) and, during the shooting of the feeder (10), the bent-up peripheral region (22) is surrounded by the material shot in and is anchored in the material of the finished shot feeder (10).

5 Claims, 3 Drawing Sheets

METHOD FOR PRODUCING A FEEDER WITH A MESH-LIKE FABRIC COVERING OVER THE FEEDER OPENING THEREOF

CROSS REFERENCE TO RELATED APPLICATIONS

The instant application should be granted the priority dates of Mar. 10, 2017, the filing date of the international patent application PCT/EP2017/055663, and Mar. 18, 2016, the filing date of German Patent Application DE 10 2016 105 106.3.

BACKGROUND OF THE INVENTION

The invention relates to a method for producing a feeder that is intended for use in a casting mold used for the casting of metals with a feeder body, which encloses an inner cavity (25) as a feeder volume, consisting of an exothermic and/or insulating material and which has at least one lateral wall region and a bottom region facing the mold cavity formed in the casting mold, the bottom region having a feeder opening arranged therein for connecting the inner cavity of the feeder body to the mold cavity of the casting mold during the casting operation. A mesh-like fabric consisting of a refractory material covers over the feeder opening.

The structure of a feeder made with the method according to the present invention is described in DE 20 2015 104 554 U1. As far as the feeder known therefrom has the form of a so-called head feeder, on the feeder, a mesh-like fabric made from a fireproof material to cover a feeder opening disposed in the bottom region. In this manner, the result should be that when the feeder is inserted into a casting mold, based on bathing of the net structure during the casting process by the hot metal after hardening of the casting piece, a metal layer penetrated by the fabric forms. This creates a defined material weakening in the bottom region of the feeder, so that knocking off of the feeder residue that remains after hardening of the casting piece occurs in the development of this fabric coating. For securing the mesh-like fabric to the feeder body, according to DE 20 2015 104 554 U1, it is provided that the mesh-like fabric is tensioned in a specialized frame and is fixed, whereby the frame is attached to the feeder body in a suitable manner, preferably is clamped to the feeder body.

The production of a feeder having a net structure arranged in its bottom region is associated with disadvantageously expensive production costs, since, in addition to the typical shooting of the feeder body into a core shooter, the specialized frame with the mesh tensioned therein must be produced and attached in an additional assembly step to the finished, shot feeder body.

SUMMARY OF THE INVENTION

The present invention therefore is based on the object of simplifying the method for producing a feeder having a mesh-like fabric covering over a feeder opening.

The invention contemplates in its fundamental idea that in the frame of production of the feeder in a core shooter, a fabric piece of the mesh-like fabric is positioned in a pattern device that forms the shape of the feeder in a core box of the core shooter, such that an edge region of the fabric piece positioned in the bottom region of the subsequently formed feeder is at least partially bent upwardly in the direction of the lateral wall region of the feeder body and the bent-up edge region, during shooting of the feeder, is surrounded by the material shot in and is anchored in the material of the finished shot feeder. The present invention, therefore, provides the advantage that the mesh-like fabric covering over the feeder opening is shot in with the production of the feeder body in one method step, so that a specialized frame for securing the mesh-like fabric is eliminated.

According to one embodiment of the invention, the fabric piece is pressed between positioning pins arranged on a base plate of the model device predetermining the bottom region of the feeder body. The positioning pins project into the lateral wall region of the subsequently produced feeder body, so that the peripheral region of the fabric piece projecting over the area surrounded by the positioning pins is bent up. Since in this manner, the positioning of the fabric piece on the bottom region of the subsequently produced feeder body is facilitated, only a supplement of the pattern device needed for the production of the feeder body in the core shooter is necessary.

In this connection, it can be provided that at least three positioning pins are distributed about the periphery of the bottom region of the feeder body. Preferably, four positioning pins are arranged with a peripheral spacing of 90 degrees, respectively.

With regard to the formation of the feeder, it can be provided that the feeder body, which is predetermined by the pattern device, is formed with an opening disposed opposite to its bottom region, which is closed by means of a plug inserted into the opening and forming a cover region of the feeder body.

Regarding a method that is suitable for producing the feeder, it can be provided further that the pattern device includes the base plate with the positioning pins arranged thereon and a pattern part releasably positioned thereon for forming the inner cavity of the finished shot feeder body, whereby the pattern part is removed from the base for positioning the fabric piece.

BRIEF DESCRIPTION OF THE DRAWINGS

In the drawings, an exemplary embodiment of the invention is shown, which is described below. In the drawings.

DETAILED DESCRIPTION OF SPECIFIC EMBODIMENTS

Figure 3:
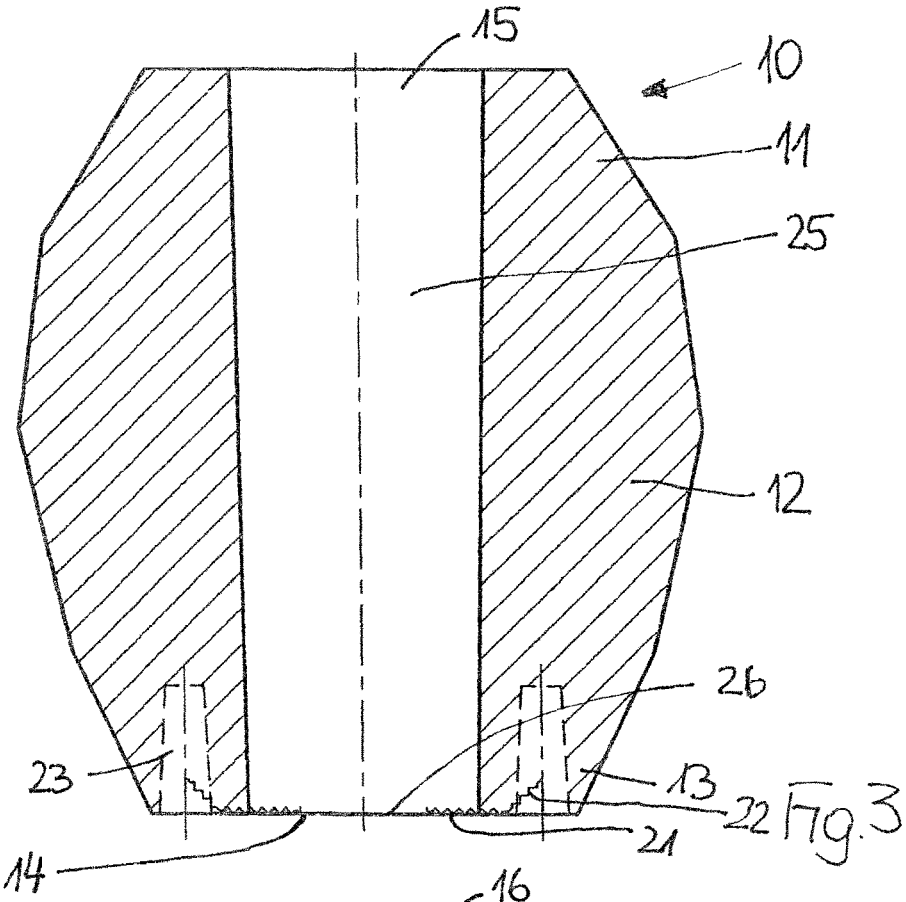
FIG. 3 shows a finished, shot feeder body with the piece of fabric anchored in its bottom region in a sectional view.
Figure 4:
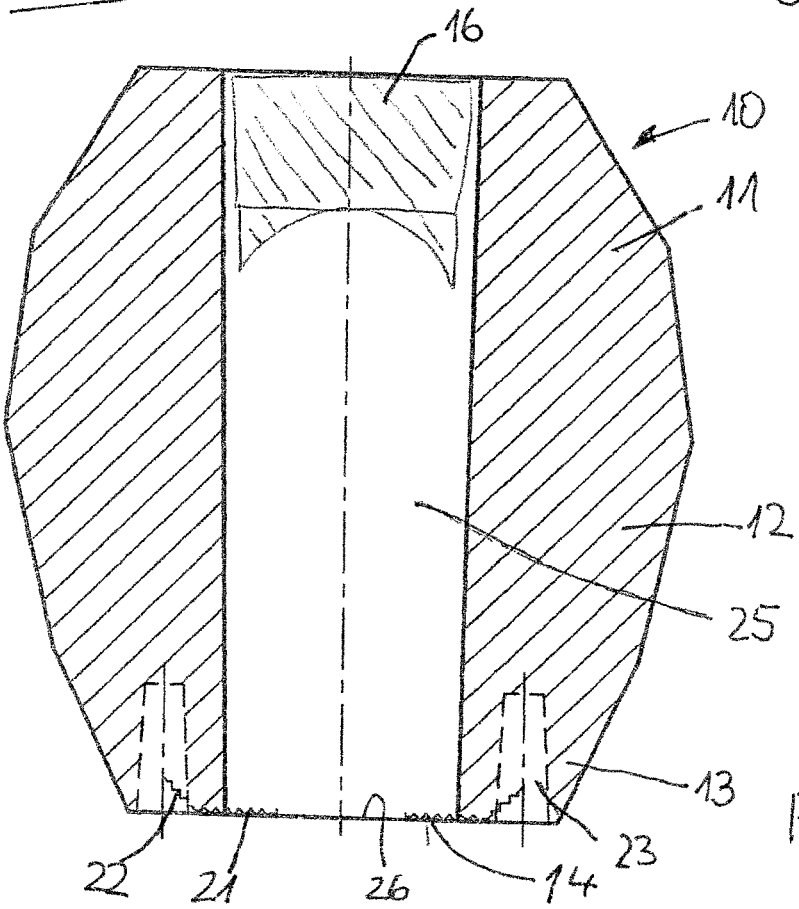
FIG. 4 shows the feeder body according to FIG. 3 after inserting a plug that forms a cover region.

The finished shot feeder body 11 of a feeder 10 shown in FIGS. 3 and 4 includes a lateral wall region 12 surrounding an inner cavity 25 as a so-called feeder volume as well as a lower bottom region 13, in which a feeder opening 14 is formed. The feeder body 11, which is finished shot in a core shooter (not shown), has first an upper opening 15 positioned opposite the feeder opening 14 in the bottom region 13, the upper opening 15 being closed by means of a plug 16 inserted therein in the frame of finishing the feeder 10 (FIG. 4). The feeder opening 14 is covered over by a fabric piece 21 comprised of a fire-resistant material, whose edge region 22, which is bent up in the direction of the lateral wall region 12, is secured in the exothermic and/or insulating material forming the bottom region 13 of the feeder 10.

Figure 1:
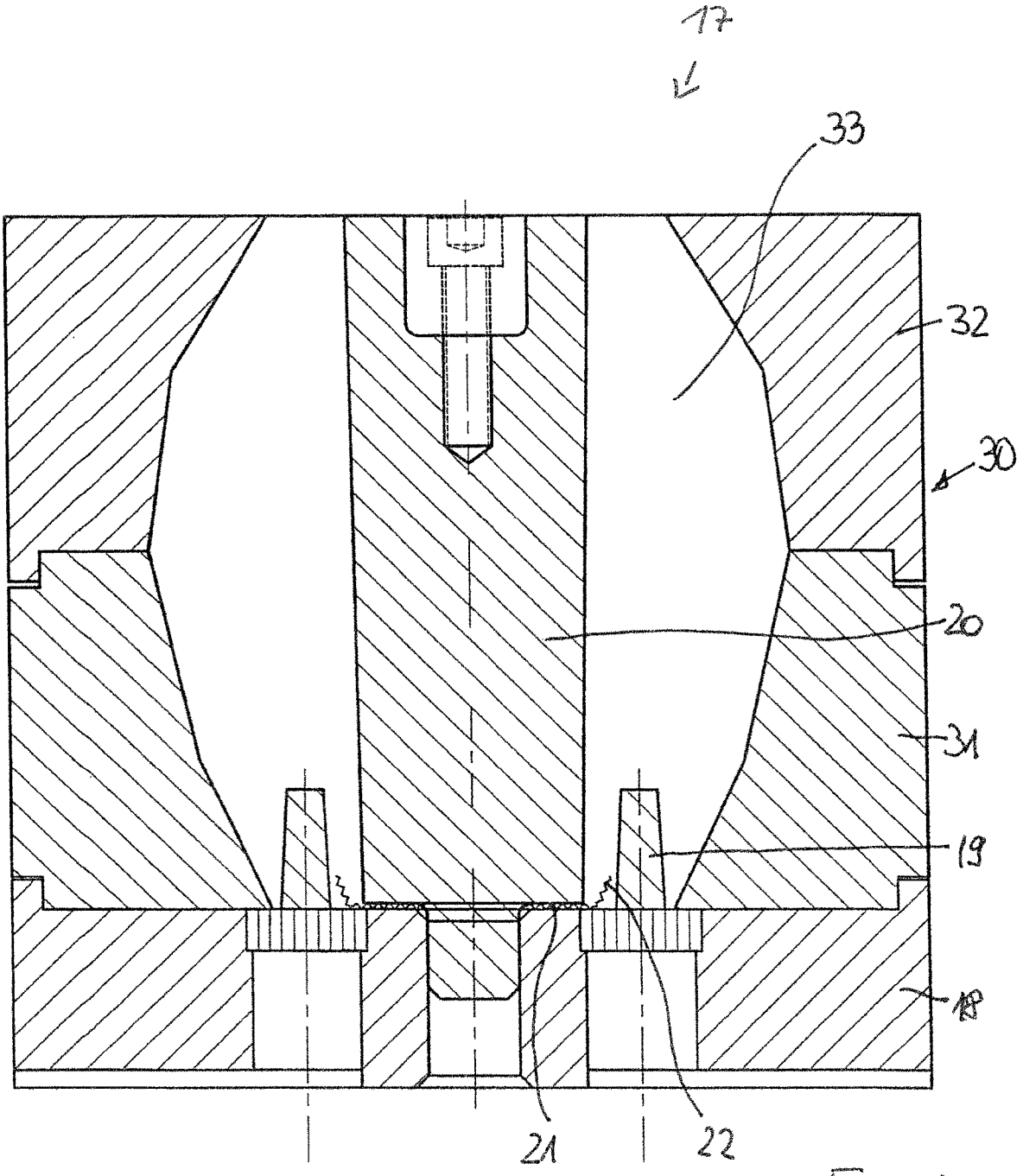
FIG. 1 shows a core box of a core shooter intended for producing a feeder with a pattern device located therein.

As the production of a feeder 10 with the structure described above is performed in a known manner by shooting into a core shooter, the design of the feeder body 10 is formed by a pattern device 17 located in a core box 30 of the core shooter that can be seen in FIG. 1 with a lower box 31 and an upper box 31. The pattern device 17 includes a base plate 18, on which a cylindrical pattern part 20 projects and which projects in a cavity 33 enclosed by the lower box 31 and upper box 32, so that during shooting of the material into the core box 30, the inner cavity 25 of the feeder body 11 is formed by the pattern part 20 and the feeder body 11 itself by the free region of the cavity 33.

Figure 2:
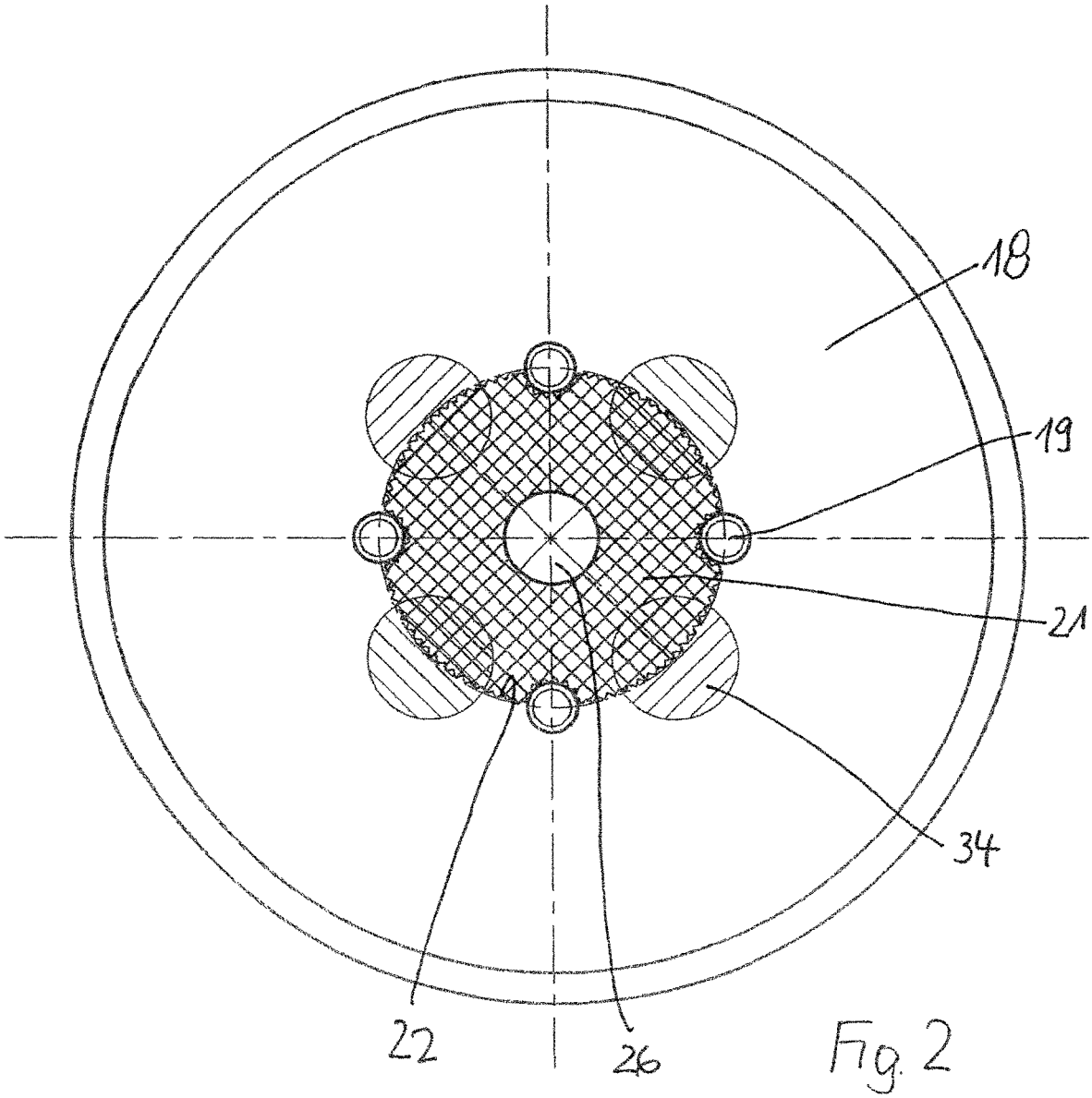
FIG. 2 shows a detail view of the base plate of the pattern device according to FIG. 1 including the positioning pin arranged thereon, with a piece of the fabric pressed therebetween upon removal of the pattern part forming the feeder volume, shown in a plan view.

At the same time, the cross sectional surface at the lower ends of the pattern part 20 also forms the feeder opening 14 formed in the bottom region 13 of the feeder body 11. For fixing the fabric piece 21 during the shooting process of the feeder 10, four positioning pins 19 are arranged with uniform spacing about the periphery of the pattern device 17 on the base plate 18. As shown in FIG. 2, after removal of the pattern part 20 from the base plate 18 in the interim, a fabric piece 21 is pressed between the positioning pins 19. Since the surface of the fabric piece 21 is greater than the surface region surrounding the positioning pins 19, by pressing in the fabric piece 21 between the positioning pins 19, the outer region of the fabric piece 21 is bent upwardly, so that the bent-up edge region 22 of the fabric piece 21 is provided, as shown in FIGS. 3 and 4. After pressing in of the fabric piece 21, the pattern part 20 is again placed onto the base plate 18 of the pattern device 17, so that the exothermic and/or insulating material that serves to make the feeder 10 can be shot into the core box. In this manner, the material encases the upright pattern part 20 and thereby forms the lateral wall region 12 of the finished, shot feeder body 11. For demolding the feeder body, first the pattern part 20 is removed via the first open, released upper opening 15 of the feeder body (FIG. 3), since the feeder opening 14 formed in the bottom region 13, based on the fabric piece 21 formed therein, for demolding of the feeder 10, could not slide over a remaining pattern part 20. In this regard, the removal of the pattern part 20 is required. Accordingly, the feeder body 11 can be removed from the core box with the fabric piece 21 formed in its bottom region 13. In this manner, the positioning pins 19 in the bottom region 13 are moved until reaching open channels 23 in the lateral wall region 12.

FIG. 2 shows additionally ventilation nozzles 34 formed in the base plate 18.

As described in DE 20 2015 104 554 U1, the fabric piece 21 formed from the mesh-like fabric has a through-hole 26 in its center for reducing the flow resistance, the through-hole 26 having smaller dimensions than the feeder opening 14 of the feeder.

The disclosed subject matter of this specification as set forth in the previous description, in the patent claims, in the abstract, and the drawings can be important individually as well as in any combination for realization of the invention in its various embodiments.

The specification incorporates by reference the disclosure PCT/EP2017/055663, filed Mar. 10, 2017 and DE 10 2016 105 106.3, filed Mar. 18, 2016.

The present invention is, of course, in no way restricted to the specific disclosure of the specification and drawings, but also encompasses any modifications within the scope of the appended claims.

The invention claimed is:

1. A method for producing a feeder (10) in a core shooter for use in a casting mold used for casting of metals, the feeder that is produced having a feeder body (11), the feeder body enclosing an inner cavity (25) as a feeder volume, the feeder body comprising an exothermic and/or insulating material and having at least one lateral wall region (12) and a bottom region (13) with a feeder opening (14) arranged therein for connecting the inner cavity (25) of the feeder body (11) to a mold cavity of the casting mold during a casting operation, the method comprising the following steps:

providing a mesh fabric consisting of a fireproof material for covering over the feeder opening (14) to be produced therein;

positioning a fabric piece (21) of the mesh fabric in a pattern device (17) of a core box (30) of the core shooter, in such a way that a peripheral region (22) of the fabric piece (21) positioned in the bottom region (13) of the feeder (10) to be produced is at least partially bent up in a direction of the at least one lateral wall region (12) of the feeder body to be produced (11), shooting of the feeder (10), wherein the peripheral region (22) is surrounded by material shot in to produce the feeder and is anchored in the material of the feeder (10), and wherein the fabric piece (21), is pressed between positioning pins (19) which are arranged on a base plate of the pattern device predetermining the bottom region of the feeder body and which the positioning pins (19) project into the at least one lateral wall region of the subsequently produced feeder body, so that the peripheral region (22) of the fabric piece (21) projecting over an area surrounded by the positioning pins (19) is bent up.

2. The method according to claim 1, wherein at least three positioning pins (19) are spaced about a periphery of the bottom region (13) of the feeder body (11).

3. The method according to claim 1, wherein at least four positioning pins (19) are spaced about a periphery of the bottom region (13).

4. The method according to claim 1, wherein the feeder body (11) is predetermined in its shape by the pattern device (17), the feeder body being formed with an upper opening (15) positioned opposite to the bottom region (13), the upper opening being closed by means of a plug inserted into the opening (15) and forming a cover region of the feeder body (10).

5. The method according to claim 1, wherein the pattern device (17) encompasses the base plate (18) with the positioning pins (19) arranged thereon and a pattern part (20) releasably positioned thereon for forming of the inner cavity (25) of the shot feeder body (11), wherein the pattern part (20) is removed from the base plate (18) for positioning of the fabric piece (21).

* * * * *